US006154934A

United States Patent [19]

Matthews

[11] Patent Number: 6,154,934

[45] Date of Patent: Dec. 5, 2000

[54] RECLOSABLE ZIPPER WITH FUSIBLE RIB LAYER

[75] Inventor: David J. Matthews, Gilman, Ill.

[73] Assignee: Illinois Tool Works, Inc., Glenview, Ill.

[21] Appl. No.: 09/247,875

[22] Filed: Feb. 10, 1999

[51] Int. Cl.[7] ..... B32B 3/06; B65D 33/24; A44B 21/00

[52] U.S. Cl. ..... 24/587; 24/304; 24/399

[58] Field of Search ..... 24/587, 400, 399, 24/304, 451

[56] References Cited

U.S. PATENT DOCUMENTS

| | | | |
|---|---|---|---|
| 4,673,383 | 6/1987 | Bentsen . | |
| 4,731,911 | 3/1988 | Gould | 24/587 |
| 4,835,835 | 6/1989 | Gould . | |
| 5,004,356 | 4/1991 | Matsui | 24/587 |
| 5,198,055 | 3/1993 | Wirth et al. | 24/587 |
| 5,216,787 | 6/1993 | Custer et al. . | |
| 5,242,516 | 9/1993 | Custer et al. . | |
| 5,384,942 | 1/1995 | Siegel | 24/587 |
| 5,551,127 | 9/1996 | May | 24/304 |
| 5,655,273 | 8/1997 | Tomic et al. | 24/587 |
| 5,747,126 | 5/1998 | Van Erden et al. | 24/587 |
| 5,832,570 | 11/1998 | Thorpe et al. | 24/304 |

*Primary Examiner*—Victor N. Sakran
*Attorney, Agent, or Firm*—Pitney, Hardin, Kipp & Szuch LLP

[57] ABSTRACT

A reclosable zipper comprised of a first profile interlockable with a second profile is provided. Each profile is provided with a fusible rib layer for sealing the zipper to package material. The fusible rib layer includes a plurality of rib portions separated by planar portions.

6 Claims, 2 Drawing Sheets

RECLOSABLE ZIPPER WITH FUSIBLE RIB LAYER

BACKGROUND OF THE INVENTION

1. Field of the Invention

The present invention relates to a reclosable zipper for use in reclosable plastic bags and packages. More particularly, the present invention relates to a reclosable zipper having a fusible rib layer on each profile.

2. Description of the Prior Art

Reclosable zippers having fusible ribs for sealing the zippers to package material are well known in the reclosable packaging art. Examples of such zippers can be found in U.S. Pat. Nos. 4,673,383, 5,216,787 and 5,242,516.

Fusible ribs offer numerous advantages. For example, as disclosed in U.S. Pat. No. 4,673,383, fusible ribs can minimize the amount of heat and pressure transferred to the body of a zipper and to the package material during sealing of the zipper to the package material, thus minimizing zipper and package distortion. In addition, as disclosed in U.S. Pat. Nos. 5,216,787 and 5,242,516, fusible ribs can be used to bond a zipper to incompatible package material when the fusible ribs are formed of a material which is compatible with the package material and the zipper.

Many prior art zippers which make use of fusible ribs, however, have proven problematic in that it is often difficult to achieve a uniform seal between the zipper and the package material. By way of example, FIG. 1 shows a cross-sectional view of a typical prior art zipper 10 having fusible ribs 24. The zipper includes a male profile 12 interlockable with a female profile 14. The male profile 12 includes a male interlocking member 16 and a flange 18 which extends laterally on either side of the male interlocking member 16 for sealing the male profile 12 to package material (not shown). Likewise, the female profile 14 includes a U-shaped female interlocking member 20 which is interlockable with the male interlocking member 16 and a flange 22 which extends on either side of the female interlocking member 20 for sealing the female profile 14 to the package material.

The male and female flanges 18, 22 each include fusible ribs 24 disposed on flange surfaces 26, 28 directed away from their respective interlocking members 16, 20. The fusible ribs 24 are made of the same material as the rest of the zipper 10. The male and female profiles 12, 14 are sealed to the package material at the fusible ribs 24 via heat and pressure, which heat and pressure causes the fusible ribs 24 to merge into bonding layers between the zipper flanges and the package material, thus sealing the profiles 12, 14 to the package material. Distortion of the zipper and the package material is minimized because the fusible ribs absorb most of the heat and pressure.

However, because of the presence of spaces 30 between the fusible ribs 24, often times the bonding layer which is achieved by the merging of the fusible ribs 24 is not uniform across the widths of the zipper flanges 18, 22. Indeed, there may be portions of the flanges 18, 22 which are not sealed to the package material at all. The result is a relatively weak seal between the profiles 12, 14 and the package material. Additionally, relatively high temperatures are required for sealing, making the zipper unsuitable for high speed reclosable package making applications.

In cases where the zipper is made from a material that is incompatible with the package material, the fusible ribs can be made of a material that is compatible with the package material and zipper, such as a sealant. A typical prior art zipper 32 which employs this type of fusible rib is shown in FIG. 2.

As with the zipper 10 of FIG. 1, the zipper 32 includes a male profile 34 interlockable with a female profile 36. The male profile 34 includes a male interlocking member 38 and a flange 40 which extends laterally on either side of the male interlocking member 38 for sealing the male profile 34 to the package material. Likewise, the female profile 36 includes a U-shaped female interlocking member 42 which is interlockable with the male interlocking member 38 and a flange 44 which extends on either side of the female interlocking member 42 for sealing the female profile 36 to the package material.

The male and female flanges 40, 44 each include fusible ribs 46 disposed on base surfaces 48, 50 directed away from their respective interlocking members 38, 42. The male and female profiles 34, 36 are sealed to the package material at the fusible ribs 46 via heat and pressure. The application of said heat and pressure activates the sealant contained in the fusible ribs 46 and causes the fusible ribs 46 to merge into bonding layers between the zipper flanges and the package material, thus sealing the profiles 34, 36 to the incompatible package material. Once again, the fusible ribs 46 minimize the heat and pressure transferred to the zipper and the package material, thus minimizing zipper and package distortion.

However, as with the zipper 10 of FIG. 1, the presence of sealant-free spaces 52 between the fusible ribs 46 results in non-uniform bonding layers, resulting in a relatively weak seal between the zipper and the package material. And as taught by U.S. Pat. No. 5,216,787, those sealant-free areas are necessary to achieve adequate sealing at a low sealing temperature.

Another technique which is commonly employed to seal reclosable zippers to package material is the use of planar sealant layers, such as disclosed in U.S. Pat. No. 4,835,835. FIG. 3 shows a typical prior art zipper 54 which makes use of such sealant layers 68.

As with the zippers 10, 32 of FIGS. 1 and 2, the zipper 54 includes a male profile 56 interlockable with a female profile 58. The male profile 56 includes a male interlocking member 60 and a flange 62 which extends laterally on either side of the male interlocking member 60 for sealing the male profile 56 to the package material. Likewise, the female profile 58 includes a U-shaped female interlocking member 64 which is interlockable with the male interlocking member 60 and a flange 66 which extends on either side of the female interlocking member 64 for sealing the female profile 58 to package material.

The male and female flanges 62, 66 each include a planar sealant layer 68 disposed on surfaces 70, 72 directed away from their respective interlocking members 60, 64. The male and female profiles 60, 64 are sealed to the package material at the male and female flange surfaces 70, 72 via heat and pressure, which heat and pressure activate the sealant layers 68, thereby sealing the zipper to the package material.

The use of such sealant layers, however, can be problematic in that, as compared to zippers which make use of fusible ribs, larger amounts of heat and pressure applied over a longer period of time are generally needed to fully activate the sealant layers and achieve a uniform seal. This can result in substantial profile and package distortion. Additionally, when sealant layers are used, especially if they are relatively thin, the seal bars tend to cause the sealant to spread unevenly, resulting in uneven and weak seal areas. Further, the longer sealing time makes such zippers unsuitable for high speed applications.

Thus, while the prior art as it relates to fusible ribs and sealant layers is fairly well-developed, it nonetheless remains susceptible to improvement.

SUMMARY OF THE INVENTION

Accordingly, it is an object of the present invention to provide a reclosable zipper which has a new and improved means for sealing the zipper to package material. It is another object of the present invention to provide a reclosable zipper which has a new and improved means for sealing the zipper to package material and which permits a uniform seal to be achieved between the zipper and the package material. It is yet another object of the present invention to provide a reclosable zipper which has a new and improved means for sealing the zipper to package material and which minimizes zipper and package distortion and/or damage caused by the sealing process. It is yet another object of the present invention to provide a reclosable zipper which has a new and improved means for sealing the zipper to package material at low temperatures and which thus can be used in high speed reclosable package making applications. Other objects will become apparent from the following discussion.

The present invention achieves the aforementioned objects by providing a reclosable zipper comprised of two interlocking profiles. Each profile includes a base and an interlocking member interlockable with the interlocking member of the other profile extending from the base.

Each profile base is provided with a continuous fusible rib layer on a surface directed away from its corresponding interlocking member. The fusible rib layer is formed of a sealant and is comprised of a plurality of fusible ribs disposed across the widths of the profile bases and planar portions of sealant between the ribs. In this manner a high speed uniform seal at a low sealing temperature can be achieved between the zipper and the package material while at the same time minimizing distortion of and damage to the zipper and package material during sealing.

The present invention will now be described in more complete detail with frequent reference being made to the figures identified below.

DETAILED DESCRIPTION OF THE PREFERRED EMBODIMENT

Figure 1:
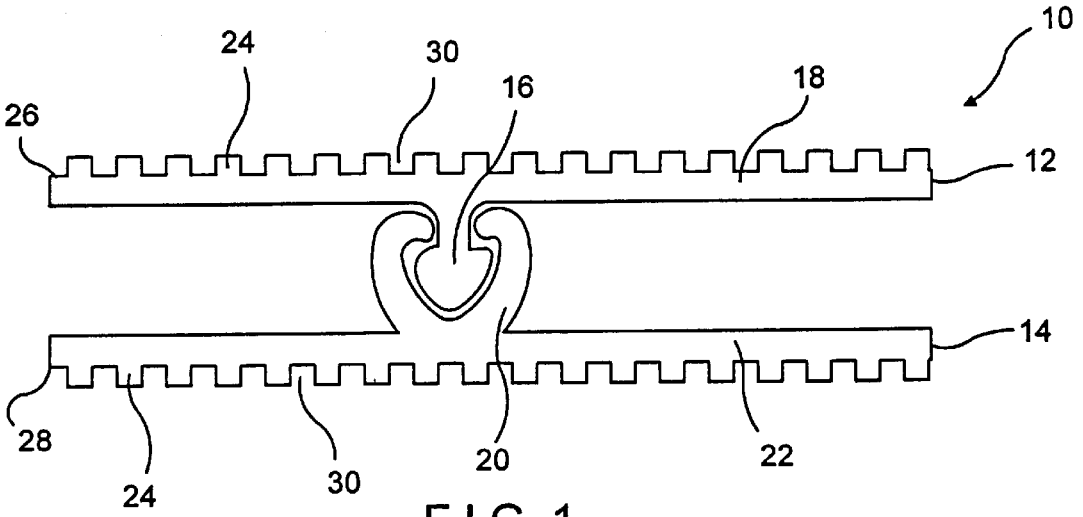
FIG. 1 PRIOR ART
FIG. 1 is a cross-sectional view of a first prior art reclosable zipper having fusible ribs.
Figure 2:
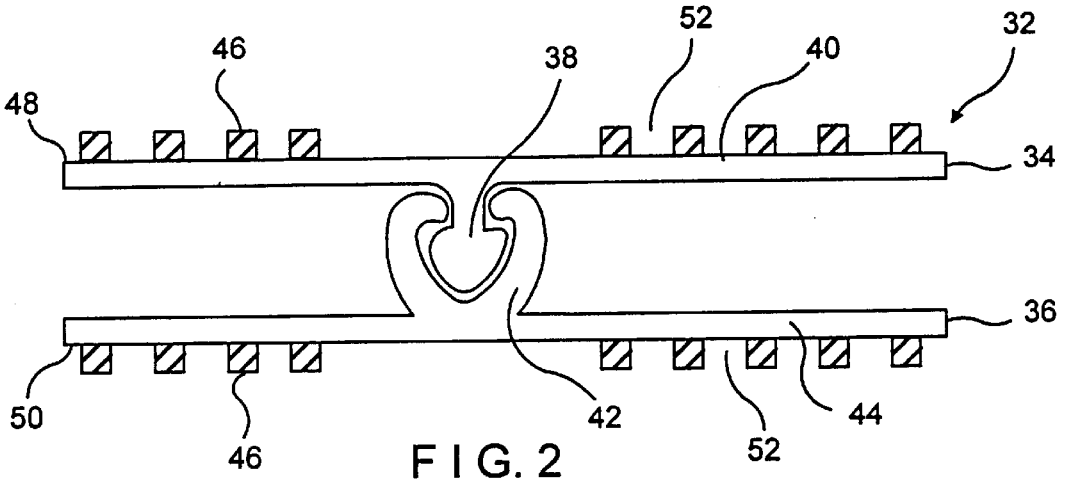
FIG. 2 PRIOR ART
FIG. 2 is a cross-sectional view of a second prior art reclosable zipper having fusible ribs.
Figure 3:
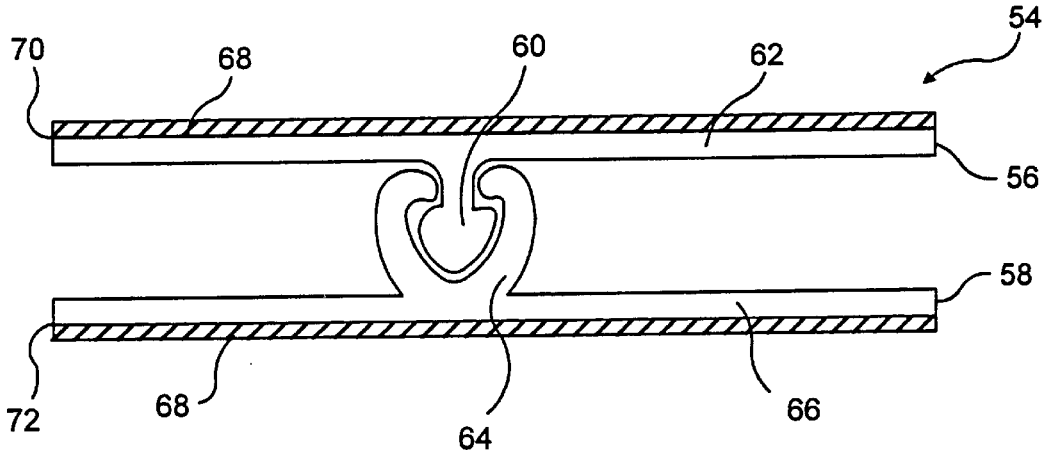
FIG. 3 PRIOR ART
FIG. 3 is a cross-sectional view of a third prior art reclosable zipper having planar sealant layers.
Figure 4:
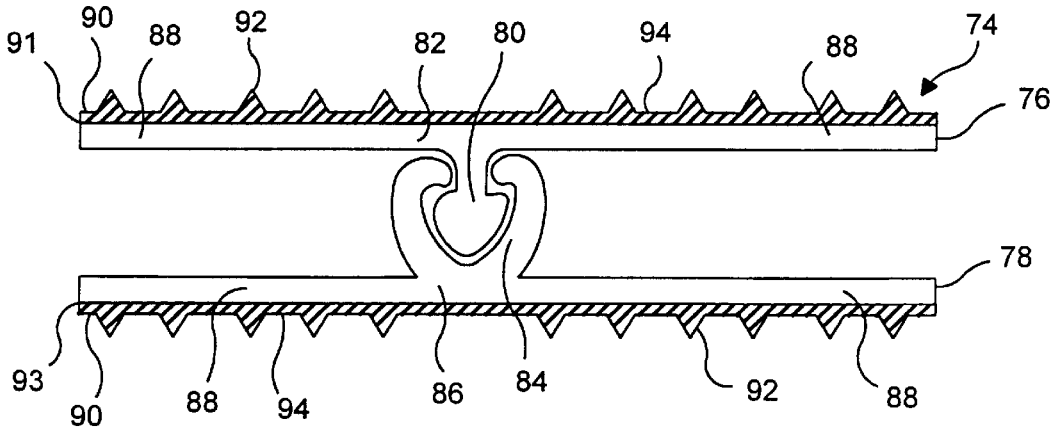
FIG. 4 is a cross-sectional view of a reclosable zipper in accordance with the present invention.

FIG. 4 shows a cross-sectional view of reclosable zipper 74 in accordance with the preferred embodiment of the present invention.

The zipper 74 has a male profile 76 interlockable with a female profile 78. The male profile 76 includes a male interlocking member 80 in the shape of an asymmetrical arrow extending from a base 82. Likewise, the female profile 78 includes a U-shaped female interlocking member 84 interlockable with the male interlocking member 80 extending from a base 86. The male interlocking member 80 is provided with an asymmetrical arrow shape so that the zipper 74 is more difficult to open from one side of the zipper (the right side of the zipper) than the other.

The profile bases 82, 86 extend on either side of their respective interlocking members 80, 84 so as to form flanges 88. The flanges 88 facilitate feeding and guiding of the zipper 74 during automated package making processes, such as on a form-fill-and seal machine, and serve as the point of sealing of the profiles to the package material. The flanges 88, however, are not necessary to practice the present invention.

Each profile base 82, 86 is provided with a continuous fusible rib layer 90 on a surface 91, 93 directed away from its respective interlocking member 80, 84 for sealing the zipper profiles 76, 78 to the package material.

The fusible rib layer 90 is a continuous layer which, preferably, is co-extruded with the zipper profiles 76, 78 and is formed from any one of many commercially available sealants well known to those of ordinary skill in the art. The sealant is preferably of the kind which is suitable for low temperature sealing applications. If desired, the sealant layer can be formed of a heat activated adhesive compatible with both the package material and the zipper.

As shown in FIG. 4, the fusible rib layer 90 is comprised of a single layer of sealant in a pattern of alternating peaks (triangular fusible ribs 92) and valleys (planar portions 94).

Figure 5:
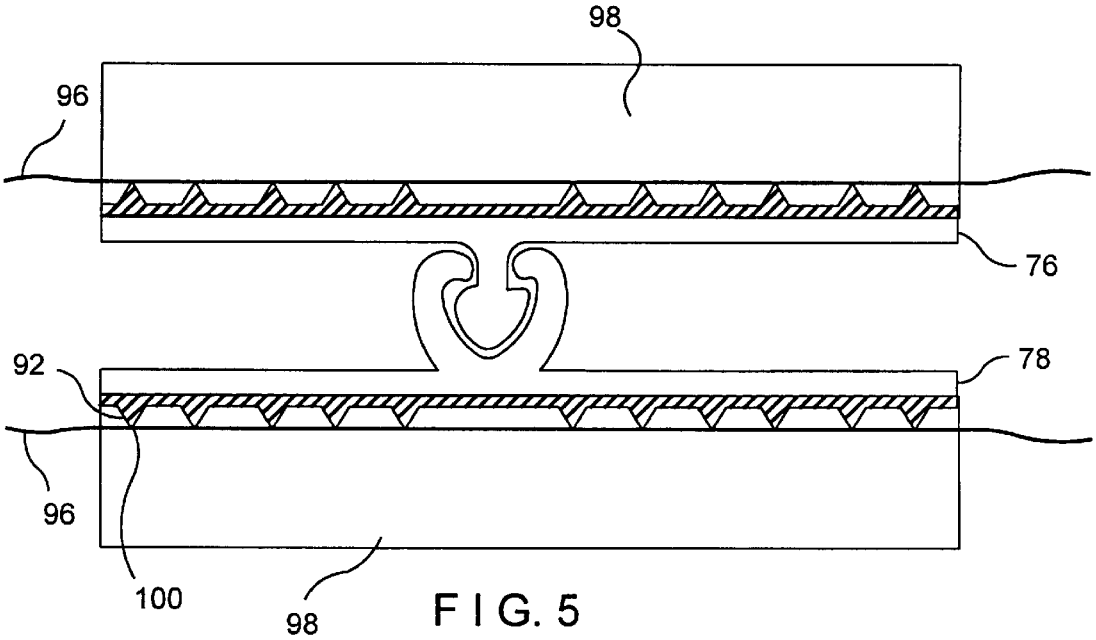
FIG. 5 is a cross-sectional view of a reclosable zipper in accordance with the present invention being sealed to package material.

FIG. 5 shows the zipper profiles 76, 78 being sealed to package material 96 by heater bars 98. To seal the zipper 74 to the package material 96, the heater bars 98 are brought into contact with the apexes 100 of the fusible ribs 92 via the packaging material, applying heat and pressure thereto. The point of contact rapidly spreads from this concentrated initial point to the remainder of the fusible ribs, activating the sealant from which the fusible ribs 92 are formed and causing the fusible ribs 92 to flatten out. Additionally, as the fusible ribs are flattened, heat and pressure from the heater bars 98 are transmitted to the planar portions 94, likewise activating the sealant contained therein.

Figure 6:
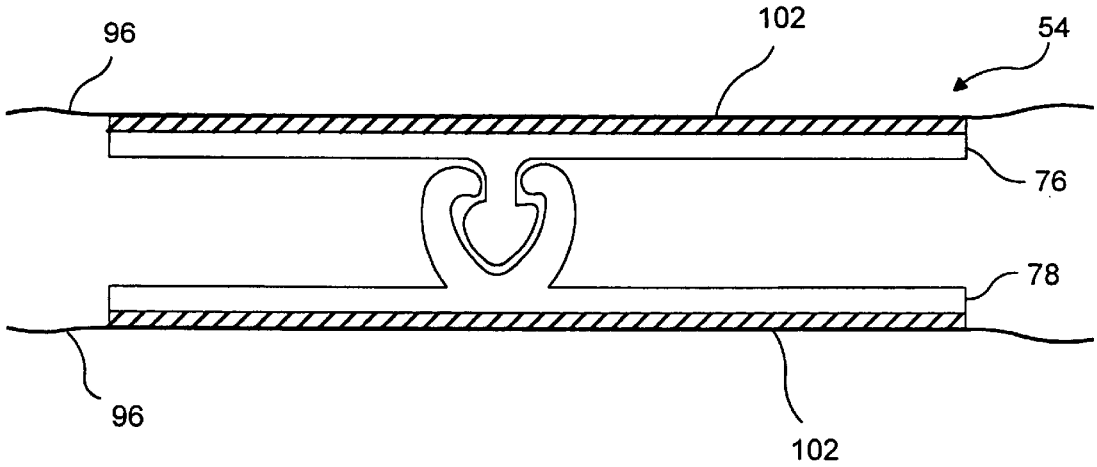
FIG. 6 is a cross-sectional view of a reclosable zipper in accordance with the present invention sealed to package material.

The heater bars 98 thus cause the sealant in the fusible ribs 92 to merge with the sealant in the planar portions 94, forming continuous, uniform planar bonding layers 102 of sealant across the zipper flanges 88, thereby maximizing the strength of the seal between the zipper profiles 76, 78 and the package material 96, as shown in FIG. 6.

The fusible ribs 92 ensure that the heat and pressure applied by the heater bars 98 do not damage or distort the zipper 74, and the planar portions 94 between the fusible ribs ensure that the resulting bonding layers of sealant 102 are uniform and continuous over complete planar areas.

While any geometrical shape may be used for the fusible ribs 92, a shape where the tips of the ribs are narrower than the bases is preferable, and a triangular shape is most preferable, as shown in FIG. 4. This triangular shape provides for a more rapid and uniform seal than other geometric shapes, such as a square, since the point of contact of the heater bars will spread rapidly from a concentrated initial point of contact at the apexes 100 of the fusible ribs 92 to a complete planar area 102. And because of this rapid action, it is possible to achieve a strong, uniform seal at a low sealing temperature.

Thus, in the above manner the objects of the present invention are achieved, namely, a stronger seal between the zipper and package material, a lower sealing temperature and a faster sealing time. Modifications to the above would be obvious to those of ordinary skill in the art, but would not bring the invention so modified beyond the scope of the appended claims.

We claim:

1. A reclosable zipper comprising:

a first profile and a second profile;

said first profile including a base; an interlocking member extending from said base toward said second profile; and a sealant layer extending continuously on a surface of said base directed away from said interlocking member;

said second profile including a base; an interlocking member extending from said base toward said first profile; and a sealant layer extending continuously on a surface of said base directed away from said interlocking member, said first and second interlocking members being engageable with each other;

each of said sealant layers including a plurality of rib portions projecting outwardly from the outer surface of each of said sealant layers, adjacent rib portions being separated by a planar portion.

2. The reclosable zipper according to claim 1 wherein said sealant layers are co-extruded with said profiles.

3. The reclosable zipper according to claim 1 wherein said rib portions are triangular in cross-section.

4. The reclosable zipper according to claim 1 wherein each of said rib portions has a tip and a base, said tip being narrower than said base.

5. The reclosable zipper according to claim 1 wherein each of said profile bases extends laterally beyond its corresponding interlocking member in at least one direction to form at least one flange.

6. The reclosable zipper according to claim 1 wherein said sealant layers are formed of a heat activated adhesive.

* * * * *